US008904687B2

(12) United States Patent
Payne

(10) Patent No.: US 8,904,687 B2
(45) Date of Patent: Dec. 9, 2014

(54) MULTIPLE INDICIA FILE FLAGGING DEVICE

(71) Applicant: Edward A. Payne, Spokane, WA (US)

(72) Inventor: Edward A. Payne, Spokane, WA (US)

( * ) Notice: Subject to any disclaimer, the term of this patent is extended or adjusted under 35 U.S.C. 154(b) by 0 days.

(21) Appl. No.: 14/072,274

(22) Filed: Nov. 5, 2013

(65) Prior Publication Data

US 2014/0123525 A1 May 8, 2014

Related U.S. Application Data

(60) Provisional application No. 61/796,185, filed on Nov. 5, 2012.

(51) Int. Cl.
*G09F 23/10* (2006.01)
*B42F 21/00* (2006.01)

(52) U.S. Cl.
CPC ..... *B42F 21/00* (2013.01)
USPC ..... 40/641

(58) Field of Classification Search
CPC ..... B42F 21/04; B42F 21/045; B42F 21/00
USPC ..... 40/641
See application file for complete search history.

(56) References Cited

U.S. PATENT DOCUMENTS

| | | | | | |
|---|---|---|---|---|---|
| 1,008,352 | A | * | 11/1911 | Meyers | 40/360 |
| 1,654,545 | A | * | 1/1928 | Lindsay | 40/359 |
| 1,697,985 | A | * | 1/1929 | Lindsay | 40/359 |
| 1,819,251 | A | * | 8/1931 | Law | 116/237 |
| 1,875,995 | A | * | 9/1932 | Dickman et al. | 101/369 |
| 2,095,141 | A | * | 10/1937 | Levin | 116/234 |
| 5,341,982 | A | * | 8/1994 | Syers | 229/67.1 |
| 6,883,460 | B2 | | 4/2005 | Weisenfeld | |
| 6,976,449 | B2 | * | 12/2005 | Weisenfeld | 116/319 |
| 6,986,219 | B1 | * | 1/2006 | Raia | 40/359 |
| 7,610,707 | B1 | | 11/2009 | Payne | |

* cited by examiner

*Primary Examiner* — Gary Hoge
(74) *Attorney, Agent, or Firm* — William Andrew Jeckle

(57) ABSTRACT

A multiple indicia file flagging device provides a flag base having a side portion carrying an adhesive, and an opposing side portion carrying a flag pivot axle and locking pegs. A flag having a "T" configuration with a first vertical leg and a second leg pivotally engages with the flag pivot axle to pivot thereon between an inconspicuous position and a conspicuous position. Locking peg notches defined in the flag releasably engage with the locking pegs to secure the flag in the desired position. A transparent sleeve carried on the file flag opposite the pivot axle carries a removable and customizable second indicia tab such for communicating information to users.

10 Claims, 9 Drawing Sheets

MULTIPLE INDICIA FILE FLAGGING DEVICE

RELATED APPLICATIONS

This utility patent application claims the benefit of earlier filed U.S. Provisional Patent Application No. 61/796,185 filed on Nov. 5, 2012, titled Multiple Indicia File Flagging Device. The entire content of the above-identified U.S. Provisional patent application is expressly incorporated herein by this reference thereto.

BACKGROUND OF INVENTION

1. Field of Invention

The present invention relates to file marking devices, and more particularly to a file flagging device, having a flag thereon that can be operated between a conspicuous position and an inconspicuous position, said flag having a sleeve for carrying a removable and customizable tab as an additional indicating indicia.

2. Background and Description of Prior Art

Folders, for holding files and papers are a necessity in offices and businesses. File folders are commonly formed of folded paperboard having pre-determined areas for attaching labels or other identifying indicia and are useful for storing paper and related articles in an orderly manner in drawers of file cabinets, desks and the like.

Many variations of the file folder are known, including manila folders, file pockets, expanding files, file wallets, and the like.

It is known to use hanging folders to receive file folders, loose papers, and the like for storage and organization. Hanging folders are made for use in drawers of storage units such as file cabinets, desks and the like. Hanging folders are commonly formed of a sheet of paperboard with at least one horizontal fold that forms the folder's bottom. The sides of the hanging folder may remain open. Folded over sleeves are provided in top edge portions of the hanging folders through which hanging rods are affixed. End portions of the hanging rods extend beyond lateral edges of the file folders and are exposed and notched at a bottom portion, enabling the hanging folders to hang upon file frames in office storage equipment, such as filing cabinets and desk drawers. A portion of the hanging folder near its top edges opposite the bottom horizontal fold may also define a series of spaced apart, parallel slots to receive and hold "arm" portions of generally transparent label holders. By insertion of the "arm" portions into the spaced apart parallel slots, the label holder is held in a reasonably secure mounted relationship upon the hanging folder. Labels may be written or typed upon, and sometimes folded, and then placed within the label holders to indicate the topic of the contents of the hanging folder to which the label holder is attached.

Files and hanging folders are often stored together with the opening oriented upwardly for easy retrieval of the contents. For example, file drawers are commonly equipped with support frames to hold a plurality of hanging folders which are often suspended in a specific order, for example alphabetically. Many times a single hanging folder will carry plural file folders which may or may not be related to one another—for example multiple individual file folders for a single client, or multiple individual file folders each for a different client.

It is common for people to collect a large number of file folders and to store the file folders in hanging folders. Some or all of the files and folders may be labeled. Unfortunately, a large collection of any file/folder type makes it difficult to identify or pick out certain files that are in need of attention at different times. Thus, a common technique is to make a separate list of files needing user attention. This requires added time and is a task that can easily be forgotten especially when multiple files need user attention.

One drawback to the use of existing file folders is the relatively time-consuming activity of replacing such folders once they are removed from a file drawer or other storage unit. Once the user removes a file from a predetermined location among other files, it requires time and effort to find the specific location the file came from when returning the file to the drawer. Since usually all of the hanging folders have a similar appearance, the user must closely inspect the identifying indicia, if any, written or carried upon each file folder and each hanging folder in the vicinity of the series of folders from which the removed file was taken. This activity takes time and can be frustrating. Additionally, there is a substantial risk that the removed file will be replaced in the wrong location, adding to further delays the next time the file or folder is needed. Further, if a person is looking for a particular file in the file cabinet, and the file is not present, that person may not know if the file has been removed, by whom the file was removed, or perhaps whether or not the file has even yet to be created. In such instances, the person looking for the file may be forced to visit multiple offices and multiple people to locate the sought after file, or in the circumstance of new files may create a duplicate file. Further, even if an indicator left in the file or folder indicates that the file has been removed, the indicator usually does not provide the person seeking the file with any information such as who removed the file or where the file might be located.

Various methods and apparatus are known to mark the position of a file removed from a set of files or folders. For example, one such method is to place a self-stick note (a Post-It®) on an adjacent file or folder to mark the location. Unfortunately, such self-stick notes often fall off. There are also tabs, tags, clips, and flags that may be used to identify a file or folder, its location or where it was originally located, such as U.S. Pat. No. 6,883,460 to Weisenfeld for a File Marking Device issued Apr. 26, 2005 and U.S. Pat. No. 7,610,707 to Payne for Combined File Flagging Devices and Label Holders issued Nov. 3, 2009. U.S. Pat. No. 7,610,707 to Payne is expressly incorporated herein in its entirety by this reference. None of these known methods or apparatus resolves all the known drawbacks nor satisfies the continuing needs of users of file folders and users of hanging folders.

There remains a need for a file flagging device that identifies files when stored in a filing array. There also remains a need for an improved file folder-flagging device having an operable flag that can be moved between an attention getting position and an unobservable position.

Further, there is a need for a file flagging device that provides a means of communicating information to a person finding an empty "flagged" location regarding who has the missing file or folder and where the file/folder may be located.

What is needed is a multiple indicia file flagging device that flags the file folder to provide a visible indication that the contents of the file folder have been removed. Further, the improved file flagging system should communicate information to a seeker of the file where the file/folder/contents may be located and perhaps the person who removed the contents of the file, by means of other additional information providing indicia.

My invention is an improvement over known apparatus and methods and resolves various of these aforementioned problems by providing a multiple indicia file flagging device having a pivoting flag attached to a file or hanging folder that may be locked in a conspicuous orientation to indicate that the file or folder contents have been removed. Further, my multiple indicia file flagging device includes additional indicating indicia comprising a transparent sleeve releasably carrying a removable and customizable secondary indicator tab. The secondary indicator tab has a color, pattern, RFID, or other information that will provide a user with additional information such as where to locate the file contents, and/or whom to speak with regarding the removed file and/or the file's contents.

Some or all of the drawbacks and problems explained above, and other drawbacks and problems, may be helped or solved by my invention shown and described herein. My invention may also be used to address other problems not set out herein or which become apparent at a later time. The future may also bring to light unknown benefits that may, in the future, be appreciated from the novel invention shown and described herein.

My invention does not reside in any one of the identified features individually, but rather in the synergistic combination of all of its structures, which give rise to the functions necessarily flowing therefrom as hereinafter specified and claimed.

SUMMARY

A multiple indicia filing flagging device provides a flag base having a first side portion carrying an adhesive, and an opposing second side portion carrying a flag pivot axle and a locking peg. A flag having a "T" configuration with a first leg and a second leg perpendicular to the first leg pivotally engages with the flag pivot axle to pivot thereon between an inconspicuous position and an conspicuous position. Locking notches defined in edge portions of the first leg of the flag releasably engage with the locking peg to positionally secure the flag in the desired position. A transparent sleeve carried on the flag opposite the pivot axle releasably carries a removable and customizable additional indicia tab for identifying indicia.

In providing such a multiple indicia file flagging device, it is:

a principal object to provide a multiple indicia file flagging device that presents plural layers of indicia for a user.

a further object to provide such a multiple indicia file flagging device that can be permanently attached to a file folder or hanging folder.

a further object to provide such a multiple indicia file flagging device that can be attached to an existing file folder or hanging folder.

a further object to provide such a multiple indicia file flagging device that makes it easy to identify where a file belongs.

a further object to provide such a multiple indicia file flagging device that can be used with a variety of folders without the need to modify associated hanging file hardware.

a further object to provide such a multiple indicia file flagging device that can be inexpensively and the easily manufactured using commonly available materials.

a further object to provide such a multiple indicia file flagging device that provides more information to user than the absence of the file contents.

a further object to provide such a multiple indicia file flagging device that permits a person removing a file from the folder to provide indicia for subsequent seekers of the file to know where the file is located.

a further object to provide such a multiple indicia file flagging device that is lockable in an inconspicuous orientation and lockable in an extended visible orientation.

a further object to provide such a multiple indicia file flagging device that is customizable for multiple users.

a further object to provide such a multiple indicia file flagging device that may be department specific.

a still further object to provide such a multiple indicia file flagging device that may be used to communicate information to users, such as confidentiality and sensitivity of files.

Other and further objects of my invention will appear from the following specification and accompanying drawings which form a part hereof. In carrying out the objects of my invention, it is to be understood that its structures, features, and steps are susceptible to change in design and arrangement and order with only one preferred and practical embodiment of the best known mode being illustrated in the accompanying drawings and specified as is required.

BRIEF DESCRIPTIONS OF DRAWINGS

Specific forms, configurations, embodiments and/or diagrams relating to and helping to describe preferred versions of my invention are explained and characterized herein, often with reference to the accompanying drawings. The drawings and all features shown therein serve as part of the disclosure of my invention, whether described in text or merely by graphical disclosure alone. Such drawings are briefly described below.

DESCRIPTION OF PREFERRED EMBODIMENT

The readers of this document should understand that the embodiments described herein may rely on terminology used in any section of this document and other terms readily apparent from the drawings and the language common therefore as may be known in a particular art and known or indicated or provided by dictionaries. Dictionaries were used in the preparation of this document. Widely known and used in the preparation hereof are *Webster's Third New International Dictionary* (©1993), *The Oxford English Dictionary* (Second Edition, ©1989), *The New Century Dictionary* (©2001-2005) and the *American Heritage Dictionary of the English Language* (4th Edition©2000) all of which are hereby incorporated by this reference for interpretation of terms used herein to more adequately or aptly describe various features, aspects and concepts shown or otherwise described herein.

This document is premised upon using one or more terms or features shown in one embodiment that may also apply to or be combined with other embodiments for similar structures, functions, features, and aspects of the invention. Wording used in the claims is also descriptive of the invention and the text of both claims and abstract are incorporated by reference into the description entirely. Terminology used with one, some, or all embodiments may be used for describing and defining the technology and exclusive rights associated herewith.

The readers of this document should further understand that the embodiments described herein may rely on terminology and features used in any section or embodiment shown in this document and other terms readily apparent from the drawings and language common or proper therefore.

Figure 7:
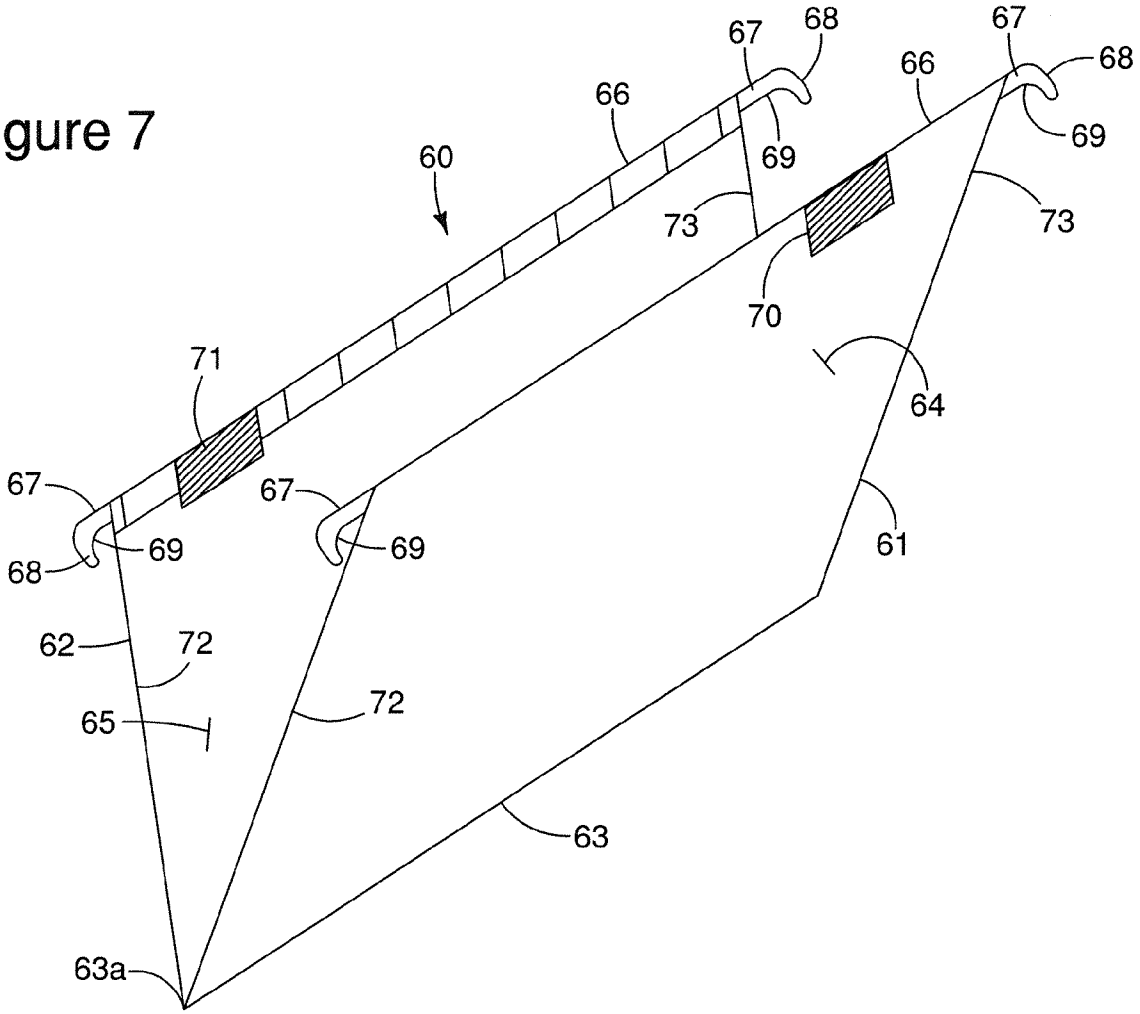
FIG. 7 is an isometric front, top and side view of a prior art hanging folder showing two possible locations for attachment of my multiple indicia file flagging device on the hanging folder.

Although my multiple indicia file flagging device of the present invention can be utilized on nearly any file folder or hanging folder, it will be described herein in the context of use with a hanging folder 60. A typical embodiment of a hanging file folder 60 is shown in FIG. 7, and has a front flap 61 connected to a rear flap 62 along a fold 63*a* at a folder bottom portion 63. The front flap 61 has an exterior surface 64 and an interior surface (not shown). The rear flap 62 likewise has an exterior surface (not shown) and an interior surface 65. In use, the fold 63*a* at the bottom portion 63 is disposed horizontally, generally parallel to top edges 66. Hanging folder 60 is distinguishable from other file folders by hanging rods 67 that are affixed to and extended along the top edges 66. End portions 68 of the hanging rods 67 extend beyond first and second lateral edges portions 72, 73 respectively of the hanging folder 60 and are exposed and typically define a downwardly opening notch 69 that allows the hanging file folder 60 to hang on a frame structure (not shown) carried within a file cabinet (not shown), desk drawer (not shown), or similar storage apparatus.

My multiple indicia file flagging device generally provides a flag base 10, a flag 25, an indicator sleeve 40, and a second indicia tab 50.

My multiple indicia file flagging device may be affixed on the exterior surface 64 or interior surface 65 of a hanging folder 60 proximate the top edge 66 of front flap 61 (such as front location 70, FIG. 7) or rear flap 62 (such as rear location 71, FIG. 7). My multiple indicia file flagging device similarly may be affixed to a file folder (not shown) at similar locations.

The flag base 10 is preferably generally rectilinear in configuration having a first side 11, a second side 12, a top edge portion 14, a bottom edge portion 15, a first lateral edge portion 16 and a second lateral edge portion 17. Adhesive (not shown), such as, but not limited to, double-sided tape is carried on the second side 12 to affix the flag base 10 to a hanging folder 60 at a desired location 70, 71 thereon. A pivot axle 18, a first locking peg 19, and a second locking peg 20 are spacedly arrayed on the flag base 10 and extend perpendicularly outward from the first side 11 of the flag base 10 for releasable engagement with the flag 25.

Figure 1:
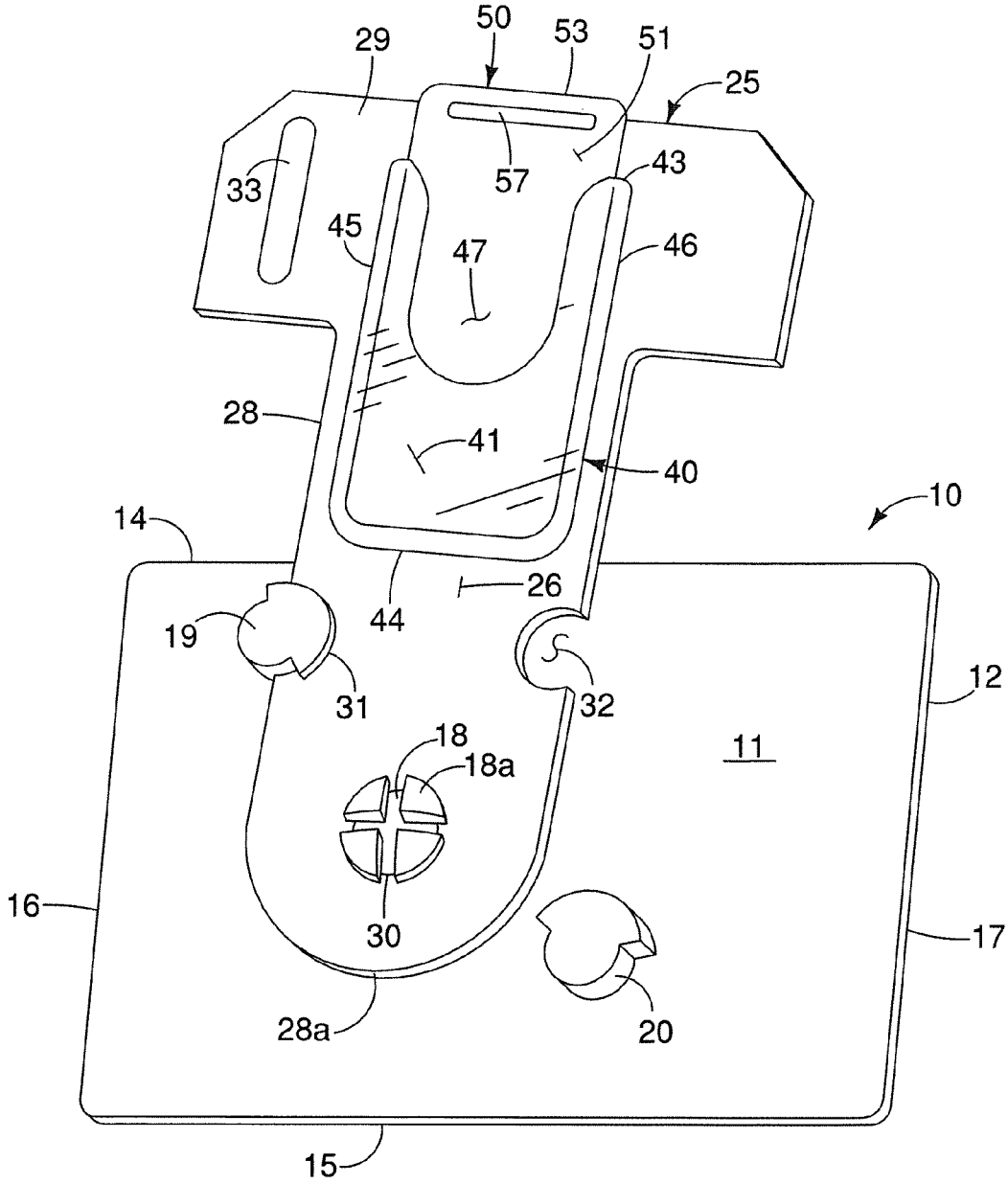
FIG. 1 is an isometric front and second edge view of my multiple indicia file flagging device showing the file flag pivoted upwardly to a locked visible orientation and carrying a second identifying indicia tab in the sleeve.
Figure 2:
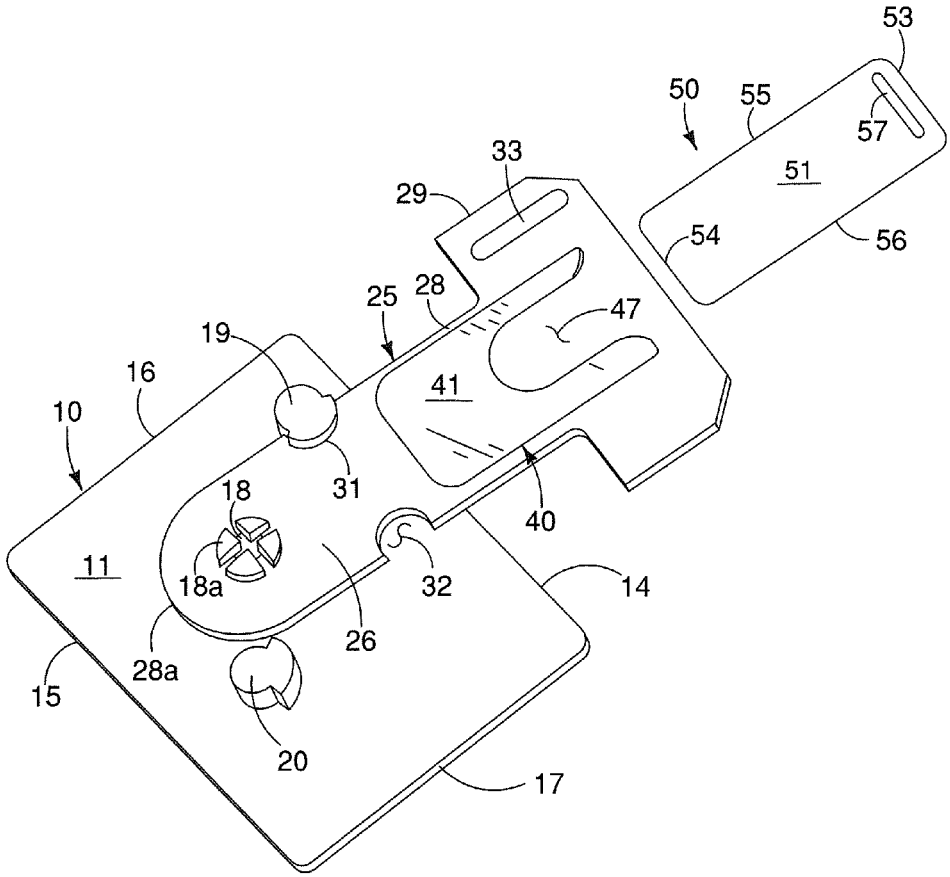
FIG. 2 is an isometric front and second edge view similar to that of FIG. 1 showing the second identifying indicia tab removed from the sleeve and aligned therewith.
Figure 3:
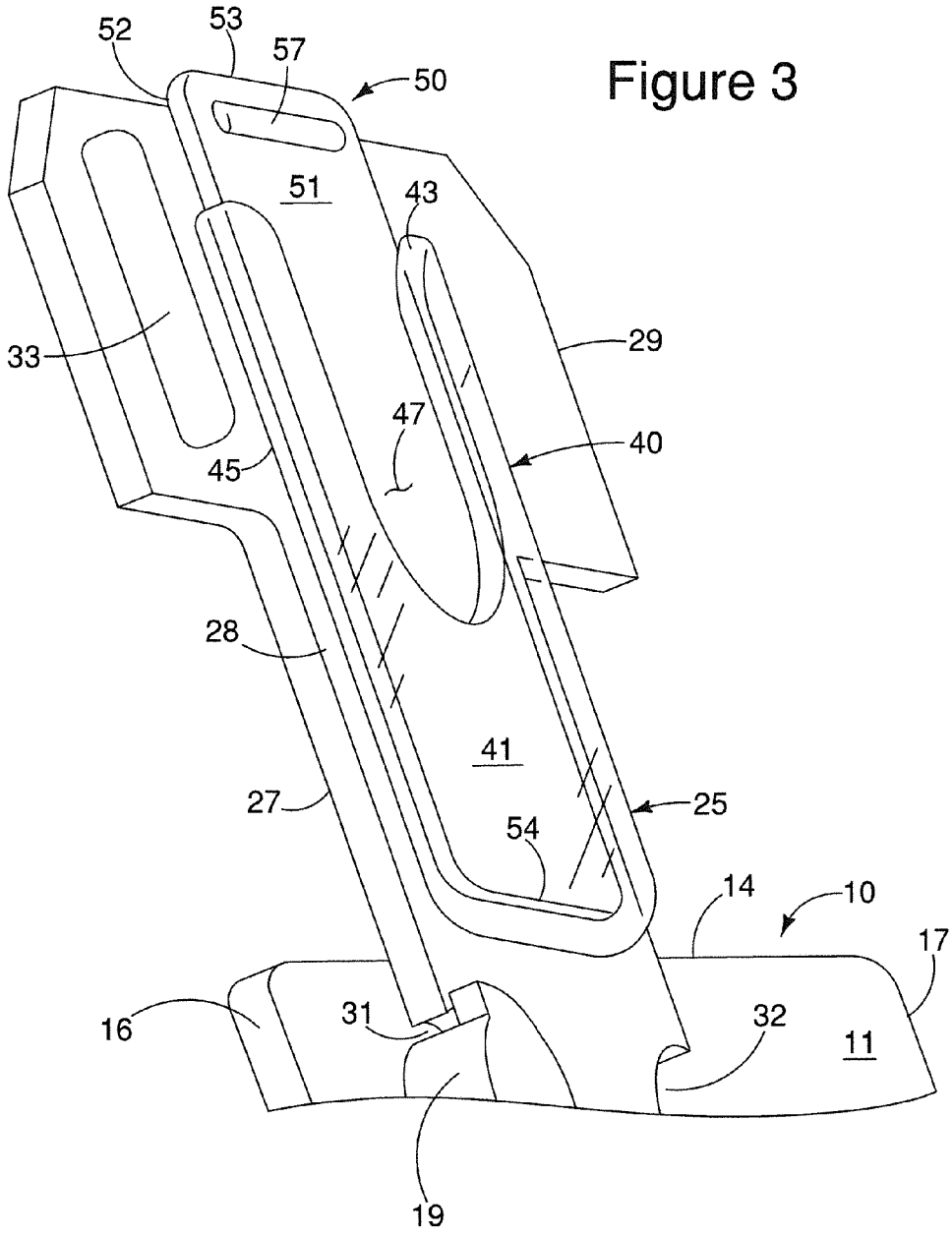
FIG. 3 is an enlarged isometric front and first edge view of the file flag of FIG. 1 showing the second identifying indicia tab within the sleeve.

The flag 25 is preferably elongated and in my preferred embodiment has a "T" configuration with a first side 26, a second side 27 an elongate first leg 28 and a second leg 29. As shown in FIG. 1, the second leg 29 is perpendicular to the first leg 28 and is carried at one end portion of the first leg 28. End portion 28*a* of the first leg 28, opposite the second leg 29 is arcuate and defines, at a position generally at the center of the arc, a pivot axle hole 30 through which the pivot axle 18 extends so that the flag 25 may pivot thereabout relative to the flag base 10. As shown in the drawings, end portion 18*a* of the pivot axle 18 opposite the flag base 10 is diametrically enlarged by known means, such as by splaying, so that the flag 25 is retained on the pivot axle 18 once the diametrically enlarged end portion 18*a* of the pivot axle 18 has passed through the pivot axle hole 30. The diametric enlargement of the end portion 18*a* of the pivot axle 18 allows the flag 25 to pivot freely on the pivot axle 18 relative to the flag base 10, but prevents the flag 25 from detaching from the flag base 10.

A first locking peg notch 31 and a second locking peg notch 32 are defined in opposing lateral edge portions of the first leg 28 at positions between the second leg 29 and the pivot axle hole 30. The locking peg notches 31, 32 each have a configuration that allows releasable engagement with the first locking peg 19 and the second locking peg 20 carried by the flag base 10 depending upon the desired orientation of the flag 25 relative to the flag base 10. In the preferred embodiment, the configuration of each locking pin notch 31, 32 is generally "C" shaped and defines an arc that is slightly greater than 180° so that edge portions of the flag 25 defining notches 31, 32 engage with the respective locking peg 19, 20 to positionally maintain the flag 25 in a desired position. Finger grip 33, which is preferably a raised ridge, is carried on the flag 25 proximate one end portion of the second leg 29. The finger grip 33 enhances the ability of a user to grip and manipulate the flag 25 to a desired orientation.

In my preferred embodiment, the flag base 10 and the flag 25 are formed of a thermal plastic such as, but not limited to, polyethylene. One important characteristic is that the flag base 10 and flag 25 are relatively rigid and yet also capable of some amount of deflection and bending to accommodate the interconnection of the flag 25 to the pivot axle 18 and also to prevent breakage during usage such as when the file drawers (not shown) are closed while the flag 25 is oriented in an extended conspicuous position causing the flag 25 to strike the file cabinet/drawer and flex as the drawer is closed.

The indicator sleeve 40 is preferably formed of a transparent or generally clear plastic such as, but not limited to polypropylene. The indicator sleeve 40 has a first side 41, a second side (not shown), a top portion 43, a bottom portion 44, a first lateral edge portion 45, a second lateral edge portion 46 and defines a U-shaped cutout 47 in the first side 41 adjacent the top portion 43. The indicator sleeve 40 defines a medial chamber (not shown) between the first side 41 and the second side (not shown) to releasably carry the second indicia tab 50. In the preferred embodiment, the indicator sleeve 40 is secured to the flag 25 by means of an adhesive, such as but not limited to double-sided tape, carried on the second side (not shown) of the sleeve 40.

Figure 4:
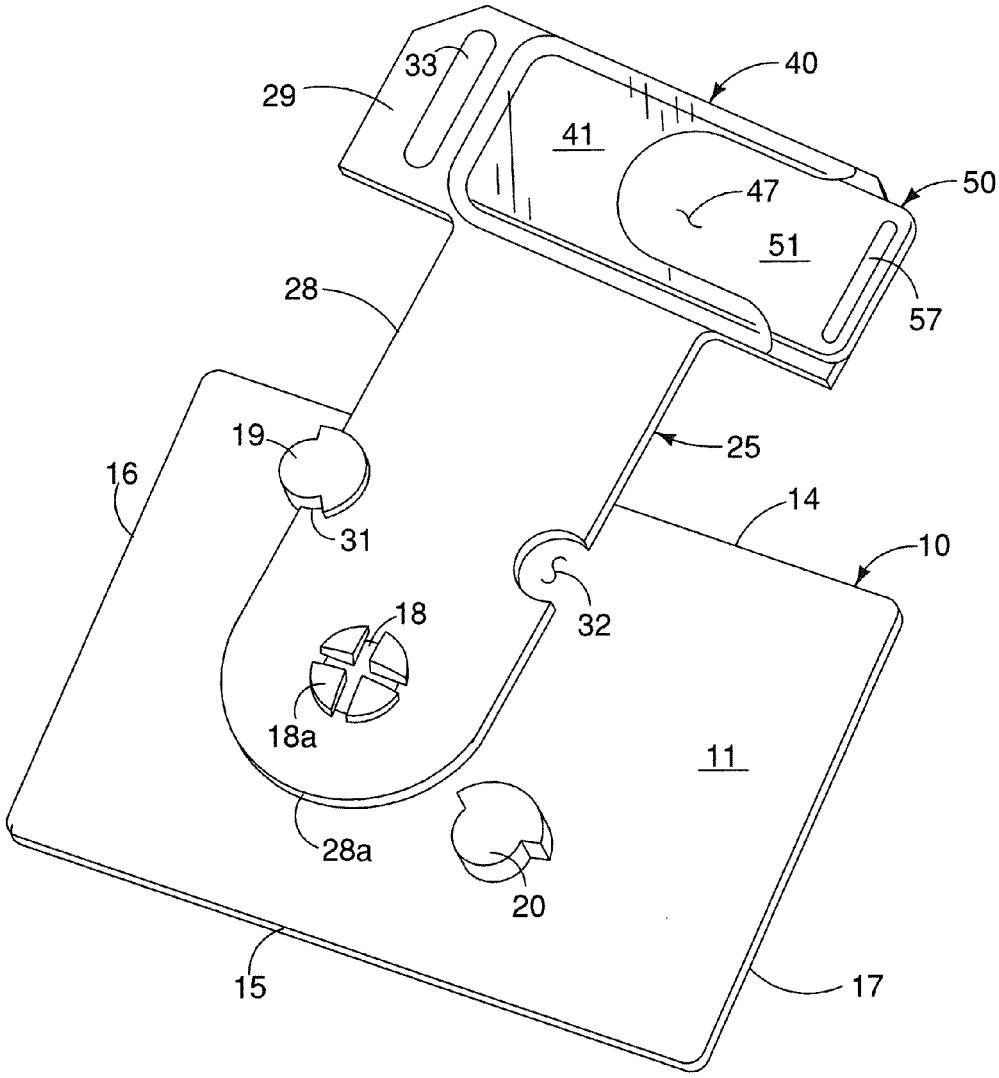
FIG. 4 is an isometric front and second edge view of a second version of my multiple indicia file flagging device showing the flag pivoted upwardly into a locked position and showing of the sleeve attached to the flag in a second orientation with the tab within the sleeve as a second indicator.
Figure 5:
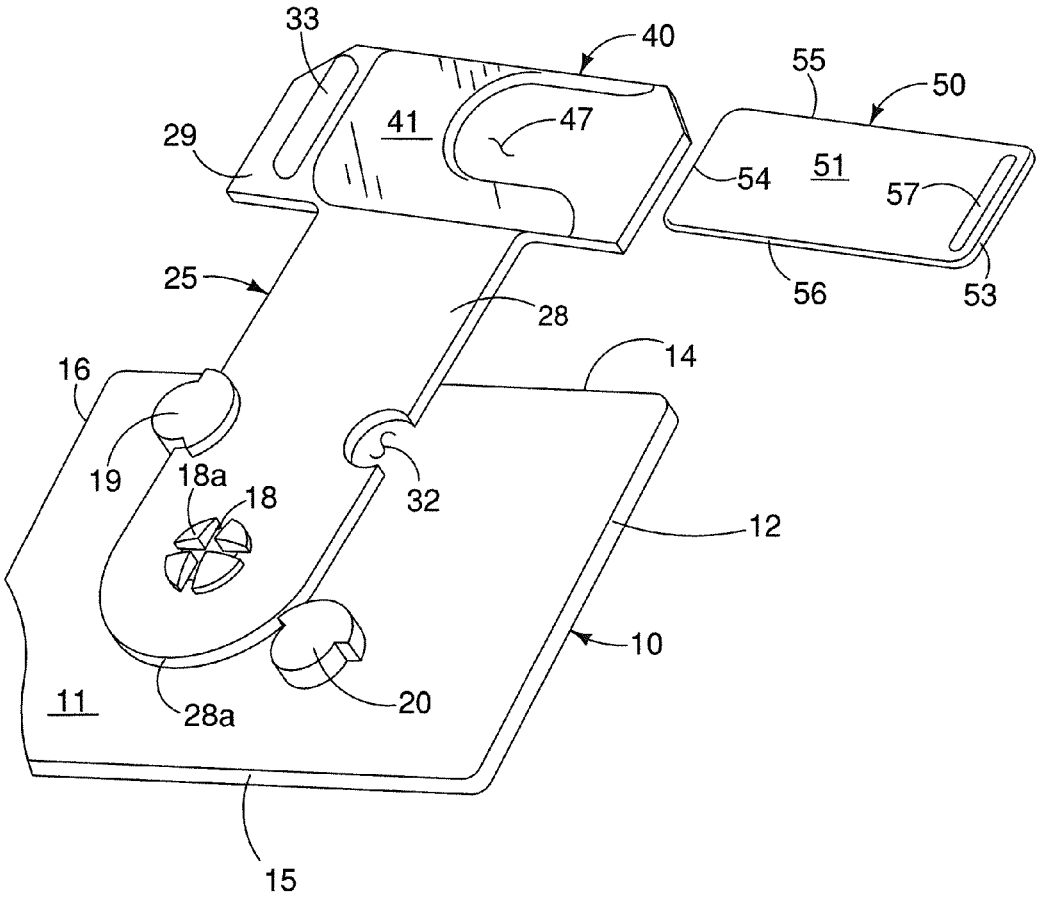
FIG. 5 is an isometric front and second edge view similar to that of FIG. 4 showing the second indicia tab removed from the sleeve and aligned therewith.
Figure 6:
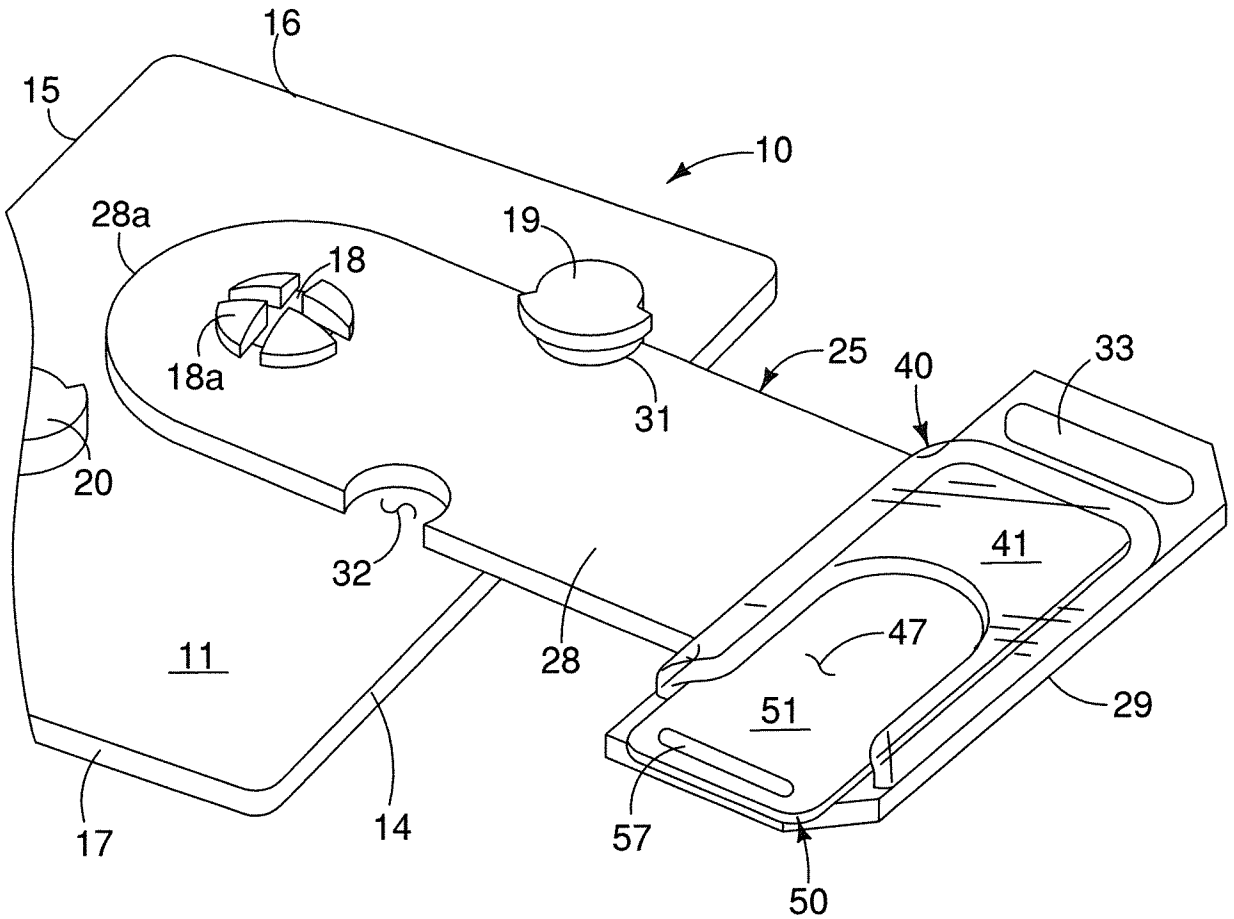
FIG. 6 is an isometric front and second edge view of the second embodiment of my multiple indicia file flagging device showing the file flag extended into a visible orientation and engaged with a locking tab carried on the body.

In the preferred embodiment, the indicator sleeve 40 is secured to the first leg 28 and is oriented perpendicular to the second leg 29 so that the top portion 43 of the indicator sleeve 40 and the U-shaped cutout 47 therein opens opposite the pivot axle 18. (FIG. 1). In a second embodiment as shown in FIGS. 4, 5 and 6, the indicator sleeve 40 is rotated approximately 90° and is secured to, and aligned with the second leg 29 of the flag 25 and is perpendicular to the first leg 28. The orientation of the indicator sleeve 40 is dependent upon the desires and needs of a user.

Figure 8:
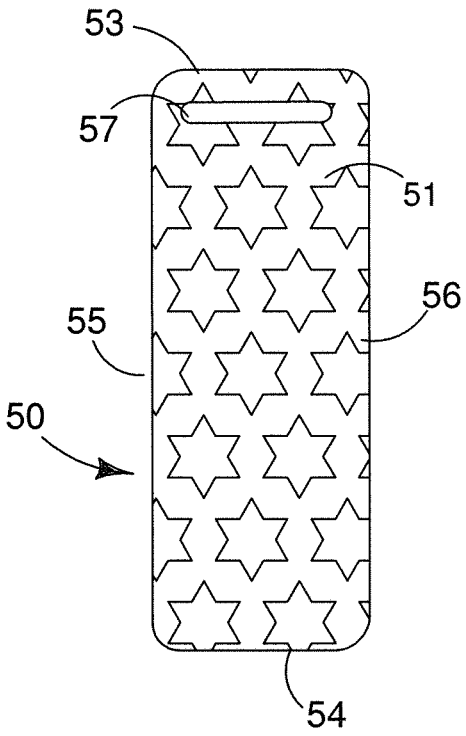
FIG. 8 is an orthographic front view of one example of a second indicia tab having additional identifying indicia on the tab, namely a pattern.
Figure 9:
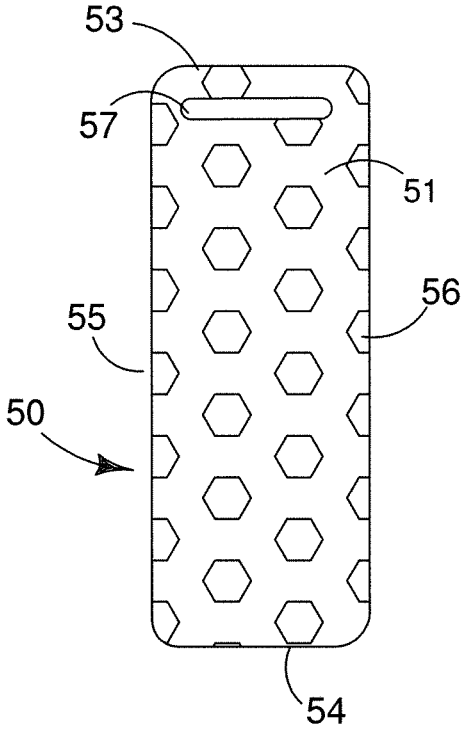
FIG. 9 is an orthographic front view of a second example of a second indicia tab having a different identifying indicia on the tab.
Figure 10:
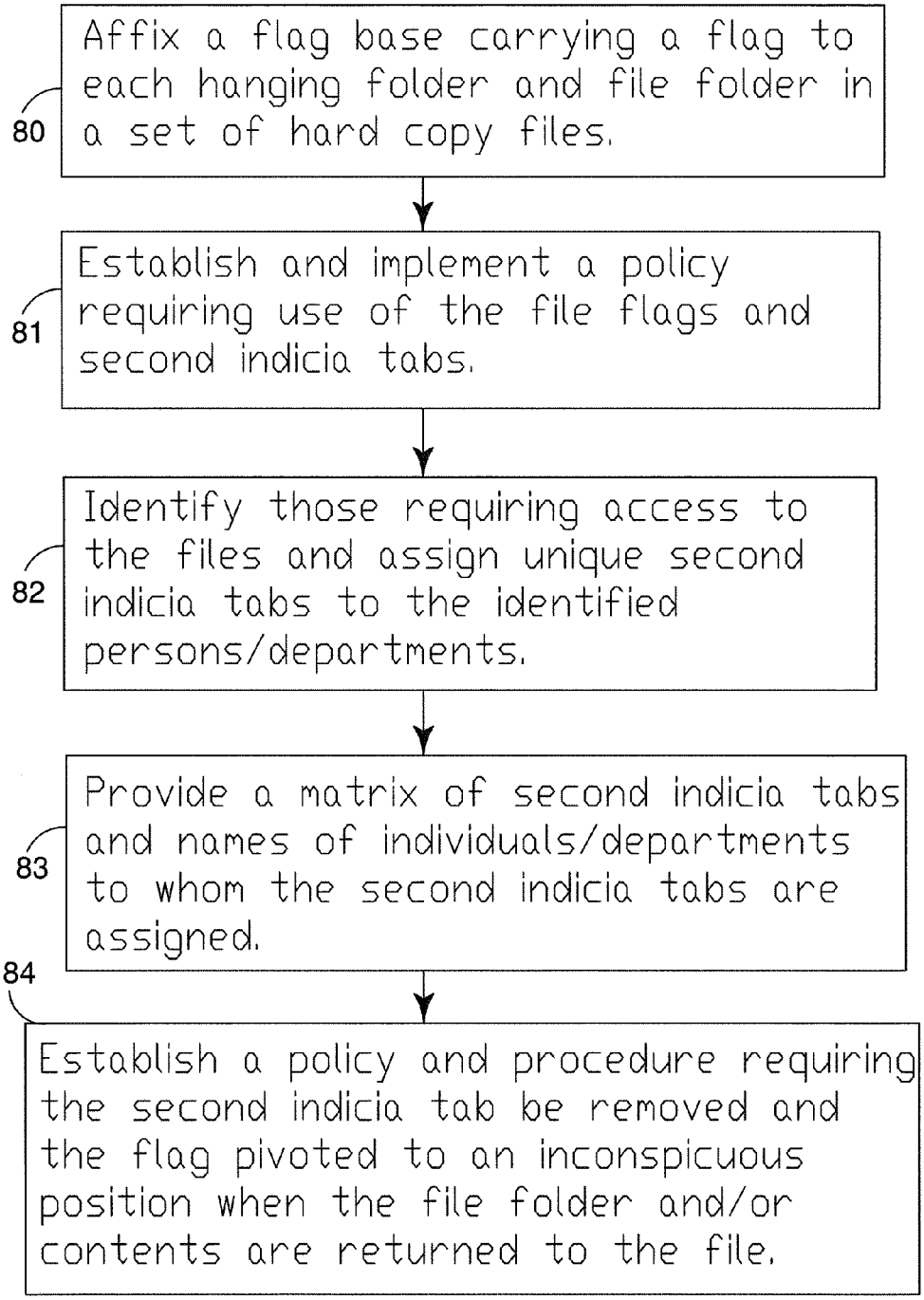
FIG. 10 is a block diagram flow chart of the steps for implementing the instant system for tracking files and folders.

The second indicia tab 50 is preferably formed of a rigid plastic and may be a variety of colors and/or patterns, (FIGS. 8 and 9) and is conducive to be written upon with erasable ink and/or pencil so that any written communication thereon may be removed as desired. It is also contemplated that the second indicia tab 50 may also carry or incorporate an electronic communication means such as, but not limited to, radio frequency identification tags (RFID) to enable electronic scanning of the second indicia tabs 50 to determine which individual and/or which department has removed a file or portions thereof. Use of such RFID tags may also increase security by providing confidentiality and expand the available number of individual identifying options that may be employed such as, but not limited to, employee phone numbers.

The second indicia tab 50 has a first side 51, a second side (not shown), a top portion 53, a bottom portion 54, a first lateral edge portion 55 and a second lateral edge portion 56. A finger tab 57 is carried proximate the top portion 53 to enhance gripping and positioning of the second indicia tab 50 by a user. In the preferred embodiment, the finger tab 57 is a raised ridge.

It is further contemplated that my invention may be employed as a system and method for tracking files within any given set of hard copy files of a business entity. The steps of this system are:

Step 1. 80 Affixing a flag base 10 carrying a flag 25 to each hanging folder 60 and file folder (not shown) at a position proximate a top edge 66 so that when the flag 25 is pivoted to an extended conspicuous position (FIG. 1) the flag 25 extends upwardly beyond the top edge 66 of the hanging folder 60 and is conspicuous.

Step 2. 81 Establish and implement a policy requiring individuals removing a file folder and/or contents of a file folder to pivot the file flag 25 upwardly to a conspicuous position and to insert a second indicia tab 50 into the file flag 25 indicator sleeve 40.

Step 3. 82 Identify which individuals and/or departments require access to the file folders and assign specific patterns/colors/RFID codes to the identified individuals and/or departments to be use for the second indicia tabs 50.

Step 4. 83 Provide a matrix of the identifiable second indicia tabs 50 containing the pattern/color/RFID code and the identified individual and/or department to whom the pattern/color/RFID code is assigned to enable file users to identify the individual/department to whom the identifiable second indicia tab 50 has been assigned to assist the file user in locating the file and/or file contents.

Step 5. 84 Establish a policy and procedure that when the file folder and/or file folder contents are returned to the hanging folder 60 or file folder (not shown) the second indicia tab 50 is removed from the indicator sleeve 40 and the file flag 25 is pivoted to an inconspicuous position.

The above description has set out various features and aspects of my invention and the preferred embodiments thereof. Such aspects and features may further be defined according to the following claims, which may individually or in various combinations help to define the invention.

Having described the structure of my multiple indicia file flagging device, its operation may be understood.

For use my multiple indicia file flagging device is affixed to the front flap 61 proximate location 70 or rear flap 62 proximate location 71 of a hanging folder 60 or other file folder (not shown) proximate the top edge 66. Affixation is made to either the interior surface 65 or the exterior surface 64. The positioning of my flagging device is such that the flag 25, when pivoted to an extended position (FIG. 1), extends above the top edge 66 of the hanging folder 60 so that it is visible and conspicuous to a user.

When the hanging folder 60 to which the flagging device is affixed is in a storage cabinet and the contents of the folder 60 are complete, or the folder 60 is not otherwise in use, the flag 25 may be pivoted downwardly so that the flag 25 does not extend above the top edge portion 66 of the hanging folder 60 and the second locking peg notch 32 is engaged with the second locking peg 20.

When a user (not shown) removes contents from the hanging folder 60 the flag 25 may be pivoted upwardly about the pivot axle 18 so that the second locking peg notch 32 disengages from the second locking peg 20 and the first locking peg notch 31 engages with the first locking peg 19 so that the flag 25 is positionally maintained in an upright visible and conspicuous orientation and is clearly and easily visible to a user.

The second indicia tab 50 having a specific/unique indicia assigned to an identifiable individual or department is placed within the medial chamber (not shown) defined by the indicator sleeve 40 so that the second indicia tab 50 is visible through the transparent material forming the indicator sleeve 40 and the finger grip 57 is accessible to a user.

If desired, the user may write information upon the second indicia tab 50, such as the name of the person removing contents from the file, or date of removal, so that subsequent users searching for the same file know where the contents located. It is also envisioned that a specific color and/or pattern of second indicia tab 50 (FIGS. 8 and 9) may be assigned to specific individuals or departments and inserted into the indicator sleeve 40 to indicate which person or department has the file contents. It is anticipated that individuals might be assigned a color in small firms and a letter or number in larger firms. A register or log may also be created and maintained to help find the person in question. Each person would be given a supply of second indicia tabs 50 with a color or other identifier for their use. The variation of colors, patterns, codes, and the like, that may be placed upon the second indicia tabs 50 is limited only by the creativity of the users but it is contemplated and envisioned herein that the second indicia tabs 50 may be used to communicate information to users.

As noted previously, it is contemplated the second indicia tabs 50 may have/include/incorporate RFID tags which maybe "scanned" by/with known RFID scanning devices to electronically "read" the RFID tags and indicate which individual's or department's second indicia tabs 50 is within the indicator sleeve 40. Use of such RFID scanners is especially efficient when multiple persons and/or departments are working on a similar matter such as, but not limited to, litigation in an attorney's office.

Once the file contents have been returned to the hanging folder 60, the flag 25 is pivoted downwardly into an inconspicuous position and the second indicia tab 50 may be removed from the indicator sleeve 40 and any information written on the second indicia tab 50 may be erased or otherwise removed.

My invention has been described in language directed to the current embodiments shown and described with regard to various structural and methodological features. The scope of protection as defined by the claims is not intended to be necessarily limited to the specific features shown and described. Other forms and equivalents for implementing the inventions can be made without departing from the scope of concepts properly protected hereby.

The foregoing description of my invention is necessarily of a detailed nature so that a specific embodiment of a best mode may be set forth as is required, but it is to be understood that various modifications of details, sizes, and rearrangement, substitution and multiplication of the parts may be resorted to without departing from its spirit, essence, or scope.

Having thusly described my invention, I file this Utility patent application.

I claim:

1. An improved file flagging device for a file folder having a front flap having a first top edge, a rear flap connected to the front flap by a bottom fold, the rear flap having a second top edge, the improved file flagging device comprising in combination:

a flag base having a first side and a second side, the second side carrying an adhesive for affixing the flag base to the file folder;

an indicator flag pivotally interconnected to the first side of the flag base on a pivot axle so that the flag may pivot thereon relative to the flag base;

a locking peg carried on the first side of the flag base to releasably engage with a locking peg notch defined in the indicator flag to positionally secure the indicator flag;

a sleeve carried on a first side of the indicator flag defining a medial chamber; and a second indicia tab releasably carried in the medial chamber of the sleeve to communicate information to a user.

2. The improved file flagging device of claim 1 wherein:

the flag has an elongate first leg interconnected to the pivot axle and a perpendicular second leg.

3. The improved file flagging device of claim 2 wherein:

the medial chamber of the sleeve is aligned with length of the first leg.

4. The improved file flagging device of claim 2 wherein:

the medial chamber of the sleeve is perpendicular to length of the first leg.

5. The improved file flagging device of claim 1 wherein:

the sleeve is transparent.

6. The improved file flagging device of claim 1 further comprising:

a unique identifier carried on the second indicia tab, the unique identifier assigned to identified persons.

7. The improved file flagging device of claim 1 further comprising:

a unique identifier carried on the second indicia tab, the unique identifier assigned to identified departments.

8. The improved file flagging device of claim 1 further comprising:

an electronic communication means carried by the second indicia tab to provide a unique identifier.

9. The improved file flagging device of claim 8 wherein:

the electronic communication means is a radio frequency identifier tag.

10. An improved file flagging system and method for tracking files within a given set of hard copy files and file folders comprising the steps:

affixing a flag base carrying a pivoting flag to each folder and file folder in the set of hard copy files at a position proximate a top edge of each file and file folder so that when the flag is pivoted to an extended conspicuous position the flag extends upwardly beyond the top edge of the file and file folder and is conspicuous;

establishing and implementing a policy requiring individuals removing a file folder and/or contents of a file to pivot the file flag into a conspicuous position and to insert a second indicia tab into an indicator sleeve carried on the file flag;

identifying persons requiring access to the files and file folders and assigning to the identified persons specific patterns/colors/RFID codes for the second indicia tabs;

providing a matrix of the identifiable second indicia tabs containing the pattern/color/RFID code and the identified persons to whom the pattern/color/RFID code is assigned to enable file users to identify the persons to whom the identifiable second indicia tab has been assigned to assist the file user in locating the file folder and file contents;

establishing a policy and procedure requiring when the file folder and file folder contents are returned to an original location the second indicia tab is removed from the indicator sleeve and the file flag is pivoted to an inconspicuous position.

* * * * *